United States Patent [19]

Davis et al.

[11] Patent Number: 4,891,676

[45] Date of Patent: Jan. 2, 1990

[54] TRANSFER MEDIUM CLEANING STATION FOR USE IN AN ELECTROPHOTOGRAPHIC PRINT ENGINE

[75] Inventors: David R. Davis, Buford; Danny L. Slayton, Lilburn, both of Ga.

[73] Assignee: Colorocs Corporation, Norcross, Ga.

[21] Appl. No.: 194,805

[22] Filed: May 17, 1988

[51] Int. Cl.[4] ..... G03G 15/21

[52] U.S. Cl. ..... 355/271

[58] Field of Search ..... 355/15, 4, 3 TR, 296, 355/299, 271; 15/256.5, 256.51, 256.52

[56] References Cited

U.S. PATENT DOCUMENTS

| | | | |
|---|---|---|---|
| 3,190,198 | 6/1965 | Eichorn | 355/15 |
| 3,386,379 | 6/1968 | Gundlach et al. | 430/126 |
| 3,672,764 | 6/1972 | Hartwig et al. | 355/15 |
| 4,275,134 | 6/1981 | Knechtel | 430/44 |
| 4,341,455 | 7/1982 | Fedder | 355/3 T R |
| 4,652,115 | 3/1987 | Palm et al. | 355/327 |
| 4,788,572 | 11/1988 | Slayton et al. | 355/317 |

FOREIGN PATENT DOCUMENTS

| | | | |
|---|---|---|---|
| 56-153357 | 11/1981 | Japan | 355/15 |

*Primary Examiner*—Joan H. Pendegrass

*Attorney, Agent, or Firm*—Jones, Askew & Lunsford

[57] ABSTRACT

Improved cleaning station for use in electrophotographic print engines which selectively removes toner from a transfer medium and has cleaning elements which are simple to remove, clean, and replace. The transfer medium cleaning station is equipped with a locking mechanism that allows inserting the cleaning station into and removing it from the print engine without scraping the transfer medium with the cleaning element.

9 Claims, 5 Drawing Sheets

TRANSFER MEDIUM CLEANING STATION FOR USE IN AN ELECTROPHOTOGRAPHIC PRINT ENGINE

TECHNICAL FIELD

The present invention relates to cleaning stations for use in color electrophotographic print engines, and more particularly relates to an improved cleaning station which selectively removes toner from a transfer medium and has cleaning blades which are easily removed, cleaned, and replaced.

BACKGROUND OF THE INVENTION

Electrophotography refers to producing photographic images by electrical means, and xerography is a form of electrophotography for copying documents and other graphic matter. Xerographic copiers are extensively used in a variety of environments, such as offices, libraries, and educational institutions.

The basic elements of a xerographic copier are well known to those skilled in the art. A light source forms an electrostatic latent image of an original document on a photosensitive medium. The photosensitive medium, as it moves within the copier, travels adjacent a source of tiny plastic particles called toner. The electrostatic force of the latent image on the photosensitive medium attracts the toner, thereby providing a developed image of toner particles on the surface of the photosensitive medium.

In color xerographic copiers, to form a complete color image the photosensitive medium must form a separate image for each color of toner used (usually primary colors) and transfer these separate images, one at a time, to a second medium, where the different colors are superimposed one upon the other. This second medium is called a transfer medium. After the complete color image is formed on the transfer medium, the complete color image is transferred through electrostatic charges to an image receptor (normally a sheet of paper or plastic). The image receptor is then passed through a heating device which melts the toner and fixes the image onto the image receptor.

After the complete color image has been transferred from the transfer medium, some toner particles remain clinging to the surface of the transfer medium. A cleaning station, mounted adjacent the transfer medium, removes the clinging toner from the transfer medium to prevent the clinging toner from contaminating subsequent images. The cleaning element of the cleaning station is normally spring loaded so that the cleaning element is forced to contact the transfer medium; however, the cleaning element cannot remain in constant contact with the surface of the transfer medium, or else the separate color images would be removed from the transfer medium before the next color image could be superimposed. Therefore, it is necessary that the cleaning element contact the transfer medium after the complete color image has been transferred to the image receptor, and then pull away from the transfer medium before encountering the first color component of the subsequent image. A device such as a solenoid-operated shaft pulls the cleaning element away from the transfer medium at the proper times.

As is well known in the prior art, the cleaning station gradually becomes filled with toner and that toner must be removed. The cleaning station must be removed from the xerographic copier before the toner can be removed therefrom. In conventional xerographic copiers, access to the cleaning station is difficult. As a result, it is difficult to remove the cleaning station without spilling toner into the copier as the cleaning station is removed. The toner is a fine powder and tends to become airborne when spilled, and this airborne toner settles throughout the copier, contaminating images formed on the photosensitive medium and causing abrasive damage to various moving parts.

When removing the cleaning station, care must be taken not to scrape the cleaning element across the transfer medium to avoid damage to the transfer medium. This is a problem because as the cleaning station is pulled from the copier, the cleaning element is pulled from the solenoid-operated shaft and springs forward against the transfer medium.

An additional problem occurs when the cleaning station is returned to the copier after cleaning the blade. The cleaning element must be aligned with the solenoidoperated shaft for the cleaning station to fit properly. To align the cleaning element, that element must be manually pressed against the springs while the cleaning station is inserted in the copier. This makes the insertion of the cleaning station in the copier awkward, and can lead to damage of the transfer medium if the cleaning element were released prematurely and sprung forward.

As is also well known in the prior art, the cleaning element of the cleaning station gradually degrades and must be replaced. In conventional xerographic copiers, the cleaning station must be removed to replace the cleaning element. Therefore, the same problems discussed above are encountered when replacing the cleaning element.

More recently, laser printers have become popular office machines. As is known to those skilled in the art, laser printers are usually constructed with print engines similar to those used in xerographic copiers. A raster-scanned laser beam creates the latent image directly on the photosensitive medium in a laser printer. After the image is created on the photosensitive medium, the printing process is similar to that in a xerographic copier. Even more recently, color laser printers and xerographic printers utilizing other techniques for creating a latent image on the photosensitive medium have become popular. Many of these xerographic printers also have cleaning stations presenting the problems discussed above.

Therefore, there is a need in color electrophotographic print engines or color laser print engines for a simpler apparatus and process for removing and replacing cleaning stations and related cleaning elements without damaging other internal parts.

SUMMARY OF THE INVENTION

The present invention solves the above problems in the prior art in several significant aspects. Generally described, the present invention includes a transfer medium for transferring toner and a cleaning element for cleaning the toner from the transfer medium. The cleaning element is removable from the print engine to remove the toner from the cleaning element or replace the cleaning element. The present invention also includes a device for moving the cleaning element into contact with the transfer medium and for alternatively moving the cleaning element away from the transfer medium. The present invention further includes a device for locking the cleaning element in a position away from the transfer medium and a device for controlling the locking device. The controlling device locks the cleaning element in a position away from the transfer medium while the cleaning element is being removed from or returned to the print engine, and unlocks the cleaning element while the cleaning element is secured within the print engine.

The novel construction of the present invention reduces the wear on the transfer medium caused by the cleaning element when the cleaning element is removed from or returned to the print engine. As removal of the cleaning element begins, the controlling device locks the cleaning element in a position away from the transfer medium. As a result, the cleaning element, as it is removed, does not scrape across the transfer medium. After the used toner is removed from the cleaning element and while the cleaning element is put back into the print engine, the cleaning element remains in the locked position, thereby preventing the cleaning element from scraping the transfer medium. As the cleaning element is finally secured within the print engine, the controlling device unlocks the cleaning element so that the cleaning element can be moved into contact with the transfer medium during operation of the print engine.

Stated somewhat more particularly, the cleaning element comprises a spring-loaded cleaning blade in a cleaning blade housing and the device for moving the cleaning element comprises a movable shaft operated by a solenoid. The controlling device also comprises a fixed shaft mounted within the print engine, and the locking device comprises a spring-operated latch. The length of the movable shaft extends beyond and parallel to the fixed shaft in the direction of the cleaning blade. While the cleaning blade is secured within the print engine, the movable shaft is connected to the cleaning blade and the fixed shaft is engaged with a spring-operated latch so that the cleaning blade is unlocked and free to move. The solenoid, through the movable shaft, moves the cleaning blade into contact with the transfer medium and back again at the proper times.

The novel construction of the present invention prevents the cleaning blade from springing forward into the transfer medium when the cleaning blade and housing are removed from within the print engine. While the cleaning blade and its holder are being removed from or returned to the print engine, the movable shaft is held in the position away from the transfer medium by the solenoid. Because the length of the movable shaft extends beyond the fixed shaft, the fixed shaft releases the spring latch, thereby locking the cleaning blade before the movable shaft releases the cleaning blade as the cleaning blade and its housing are pulled out of the print engine. Because the cleaning blade is locked before the movable shaft releases the cleaning blade, the cleaning blade cannot spring forward into the transfer medium.

The novel construction of the present invention also prevents the cleaning blade from springing forward into the transfer medium when the cleaning blade and housing are returned to the print engine. As the cleaning blade and holder are inserted into the print engine, the movable shaft engages the cleaning blade before the fixed shaft engages the locking means and unlocks the cleaning blade. As a result, the cleaning blade is held in the position away from the transfer medium by the solenoid when the cleaning blade is unlocked.

Another advantage of the present invention is that the cleaning blade, as it is put back into the print engine, is in a locked position and is therefore aligned with the movable shaft. The cleaning blade and its holder thus are more easily inserted back into position within the print engine.

Therefore, it is an object of the present invention to provide an improved electrophotographic print engine.

It is another object of the present invention to provide an electrophotographic print engine for removing used toner from a cleaning element with minimal damage to a transfer medium.

It is another object of the present invention to provide an electrophotographic print engine for removing used toner from a cleaning element with minimal damage to the cleaning element.

It is a further object of the present invention to provide an electrophotographic print engine for removing used toner from a cleaning element with a minimum of toner dispersion.

Other objects, features, and advantages will become apparent from reading the following specification in conjunction with the accompanying drawings.

DETAILED DESCRIPTION OF THE PREFERRED EMBODIMENT

Figure 1:
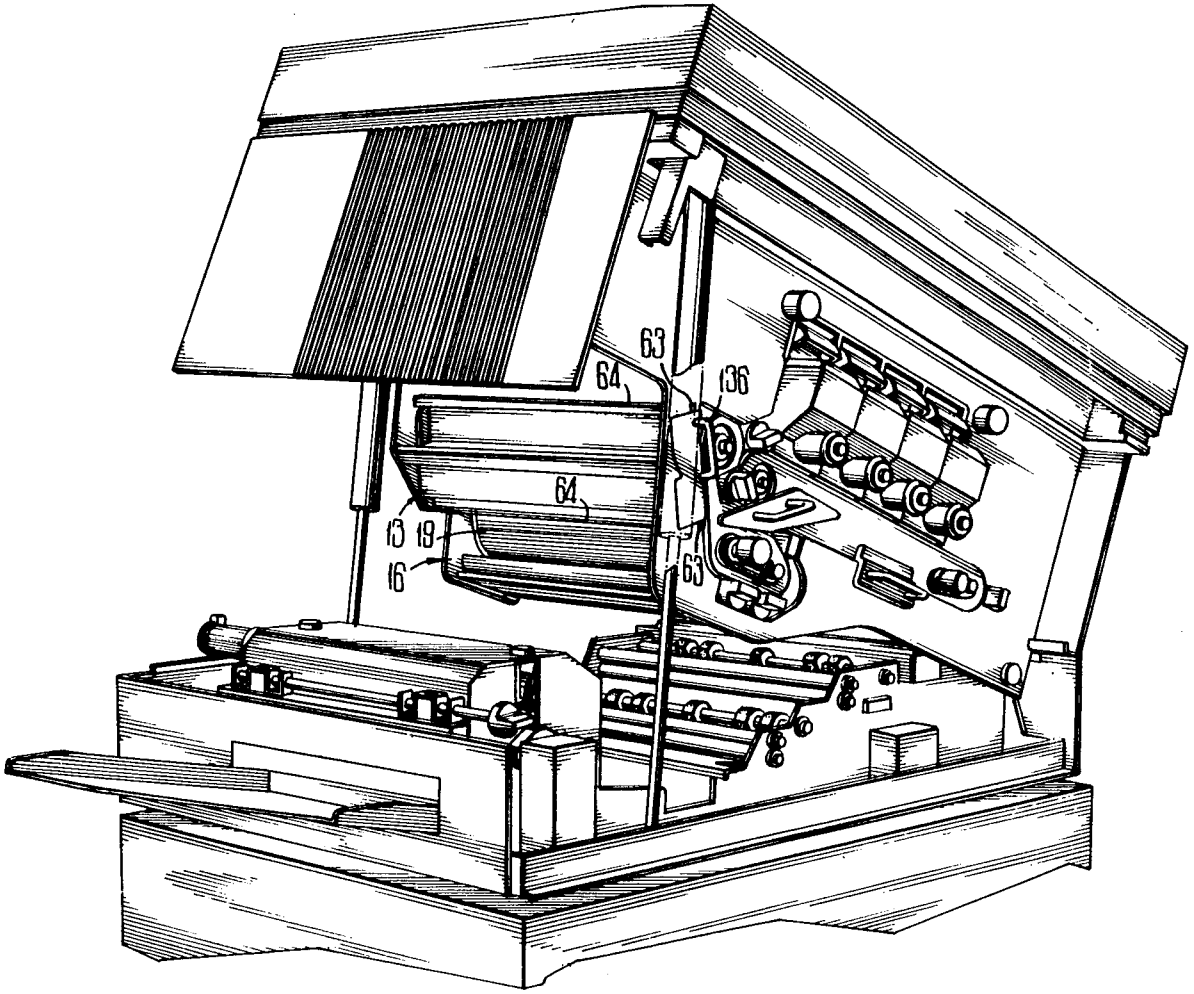
FIG. 1 is a pictorial view of an open electrophotographic print engine, according to a preferred embodiment of the present invention, showing the transfer belt cleaning station.
Figure 2:
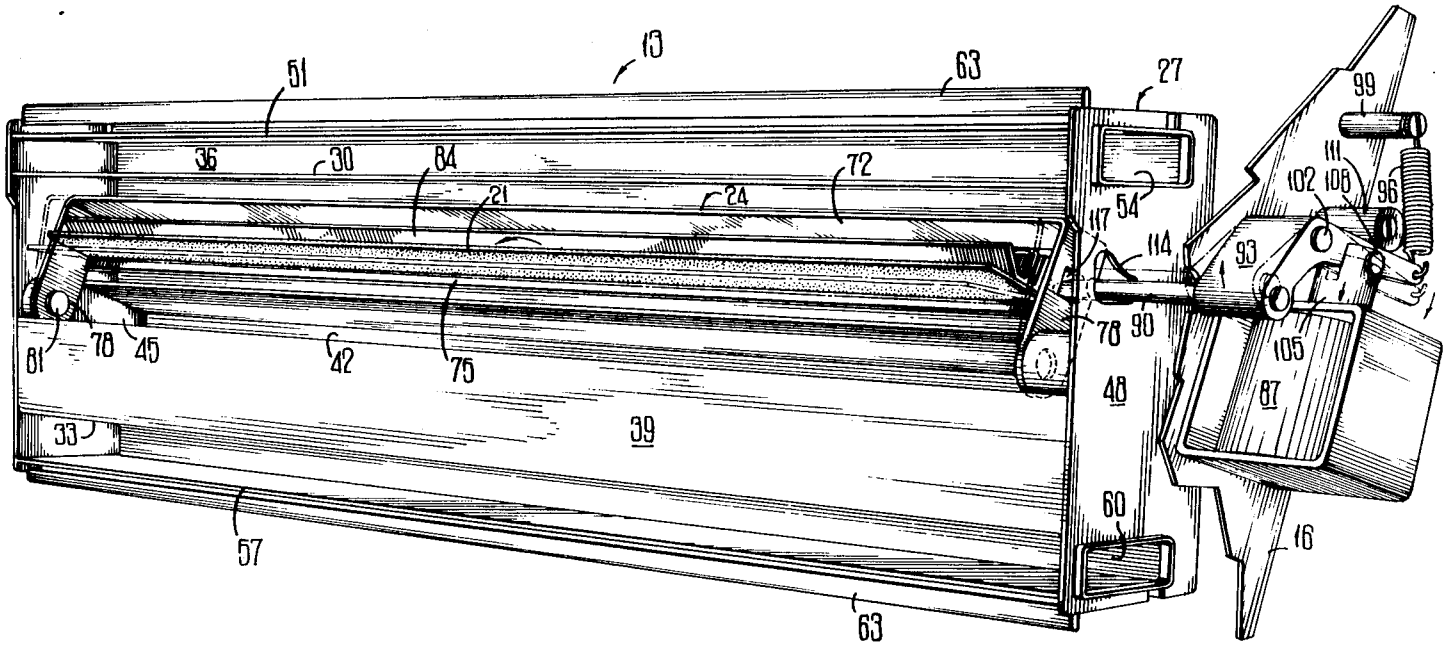
FIG. 2 is a fragmentary pictorial view of the transfer belt cleaning station in the preferred embodiment, as viewed from the hidden side in FIG. 1, illustrating the solenoid manipulating the cleaning blade.
Figure 3:
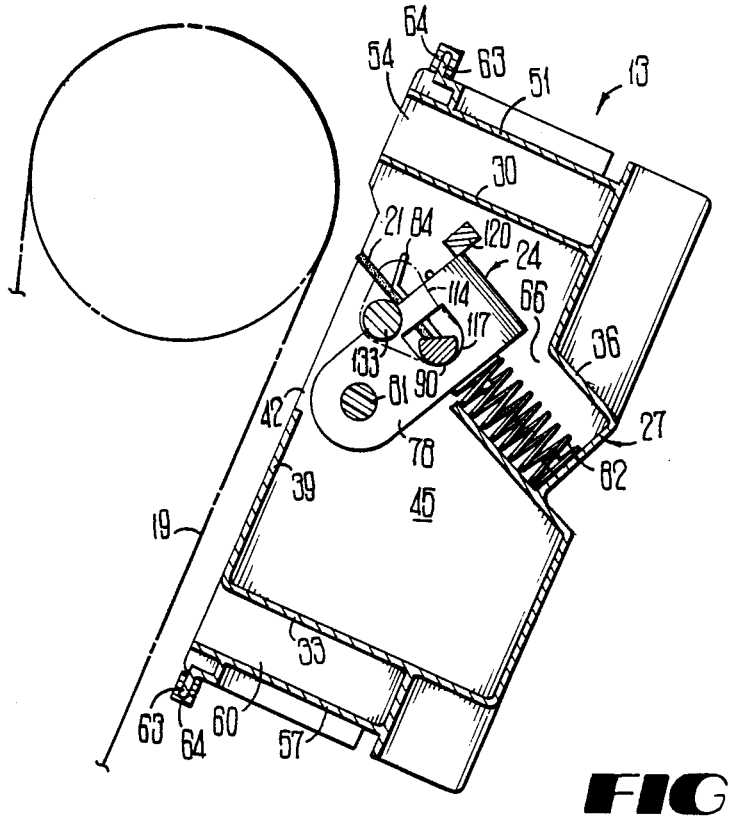
FIG. 3 is a sectional elevation view of the transfer belt cleaning station illustrating the cleaning blade holder in the locked position.

As shown generally in FIG. 1, the electrophotographic print engine 10 includes a transfer belt cleaning station 13 mounted within the upper frame 16 of the print engine proximate to the transfer belt 19. A pair of U-bars 64 on the upper frame 16 provide sliding support for the flanges 63 on the cleaning stations, permitting sliding, removal and reinstallation of the cleaning station at the side of the upper frame. The handle 136 on the outer end of the cleaning station 13 assists manipulation of the cleaning station. Turning to FIGS. 2 and 3, the transfer belt cleaning station 13 comprises a cleaning blade 21 mounted to a cleaning blade holder 24 disposed in a cleaning blade housing 27. The cleaning blade 21 is conventionally made of an elastomeric material such as rubber, which effectively removes toner from the transfer belt 19 without damaging the surface of the transfer belt. The cleaning blade housing 27 comprises an upper plate 30 spaced apart from a parallel lower plate 33, a contoured rear plate 36 extending between the back edges of the upper and lower plates, a partial front plate 39 extending upwardly from a forward edge of the lower plate, and end plates 45 and 48 which extend between the ends of the upper and lower plates and give the cleaning blade housing a box-line appearance with a rectangular cleaning blade opening 42 defined by the space between the upper plate and the top edge of the partial front plate. An L-shaped extrusion 51 extends from the upper plate 30 to form an upper channel 54 with a rectangular opening facing the transfer belt 19. Another L-shaped extrusion 57 extends from lower plate 33 to form a lower channel 60 with a rectangular opening adjacent the front plate 39. The lower slide channels 54 and 60 trap toner particles that become airborne during the operation of the cleaning station 13.

Figure 7:
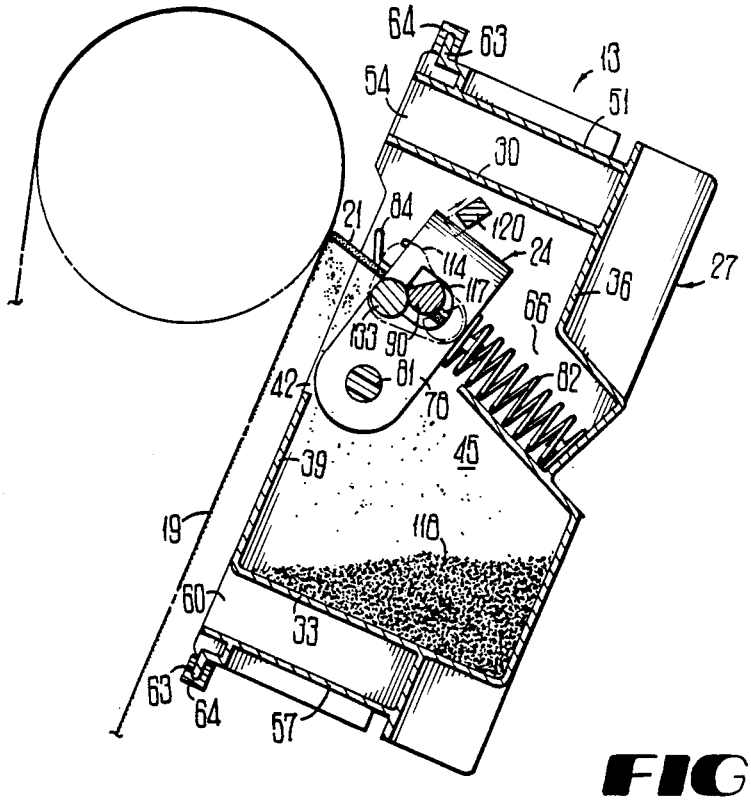
FIG. 7 is a sectional elevation view of the transfer belt cleaning station illustrating the cleaning blade holder in the unlocked position.

Two extruded flanges 63, one flange extending upwardly from L-shaped extrusion 51 along the length of the cleaning blade housing 27 and one flange extending downwardly from L-shaped extrusion 57 along the length of the cleaning blade housing, both substantially aligned with one another, provide rails for the cleaning blade station 13 to slide in and out of the print engine 10 on the two U-bars 64 (FIG. 1) which are secured to the upper frame 16 of the print engine. FIGS. 3 and 7 detail the structural relation between the flanges 63 and the U-bars 64.

The contoured rear plate 36 forms a three-sided rectangular channel 66 within the cleaning blade housing 27. The open side of the rectangular channel 66 faces the cleaning blade opening 42. The cleaning blade holder 24 extends along the length of the cleaning blade opening 42 and comprises a top plate 72, a rear plate 75 (partially shown in FIG. 2), and arms 78 extending downwardly from the top plate on opposite ends of the cleaning blade holder. The rear plate 75 faces the cleaning blade opening 42 of the housing 27.

The cleaning blade holder 24 is mounted within the cleaning blade housing 27 on pins 81 extending from the end plates 45 and 48 through holes in the arms 78. The pins 81 allow the cleaning blade holder 24 to oscillate within the cleaning blade housing 27. Springs 82 are mounted in the rectangular channel 66 of the cleaning blade housing 27 to provide a positive force urging the cleaning blade holder 24 through the cleaning blade opening 42. The springs 82 are attached to pegs behind the rear plate 75 of the cleaning blade holder.

The cleaning blade 21 is mounted on a cleaning blade support 84, and both the cleaning blade and the cleaning blade support extend the length of the cleaning blade holder 24. The cleaning blade support 84 is removably mounted to the cleaning blade holder 24 with a screw. The cleaning blade 21 extends beyond the cleaning blade support 84 in the direction of the cleaning blade opening 42.

As shown in FIG. 2, a solenoid 87 is mounted on the print engine upper frame 16. A movable shaft 90 is fixed to one end of a solenoid lever arm 93, and the movable shaft extends therefrom towards the interior of the print engine 10 and the cleaning blade station 13. One end of a spring 96 is connected to the opposite end of the solenoid lever arm 93. The opposite end of the spring 96 is fixed to the print engine upper frame 16 with a bolt 99. A pin 102 is fixed to the upper frame 16 and extends through the solenoid lever arm 93 at a point between the movable shaft 90 and the spring 96, creating a fulcrum about which the solenoid lever arm 93 can rotate. Between the pin 102 and the spring 96, the solenoid lever arm 93 is attached to a solenoid armature 105 with another pin 108 about which the solenoid lever arm can rotate. A cylindrical stop 111 is bolted to the upper frame 16 to limit movement of the solenoid lever arm 93 when the solenoid is deactivated.

When the transfer belt cleaning station 13 is secured within the print engine 10 as shown in FIG. 2, the movable shaft 90 extends through an opening 114 in the end plate 48 and through an opening 117 in one arm 78 of the cleaning blade holder 24. The operation of the solenoid 87 with the movable shaft 90 pushes the cleaning blade holder 24 towards the cleaning blade opening 42 so that the cleaning blade 21 makes contact with the transfer belt 19, thereby removing the used toner therefrom (see FIG. 7). The used toner 118 collects in the cleaning blade housing 27. The solenoid 87, when activated, pulls the solenoid armature 105 down and rotates the solenoid lever arm 93 clockwise (as viewed in FIG. 2) thereby raising the movable shaft 90 and the cleaning blade holder 24 toward the transfer belt 19 as shown in FIG. 7. When the solenoid 87 is deactivated, spring 96 rotates the solenoid lever arm 93 counterclockwise, thereby lowering the movable shaft 90 and pushing the cleaning blade holder 24 against the springs 82. As a result, the cleaning blade 21 is pulled away from the transfer belt 19.

Figure 4:
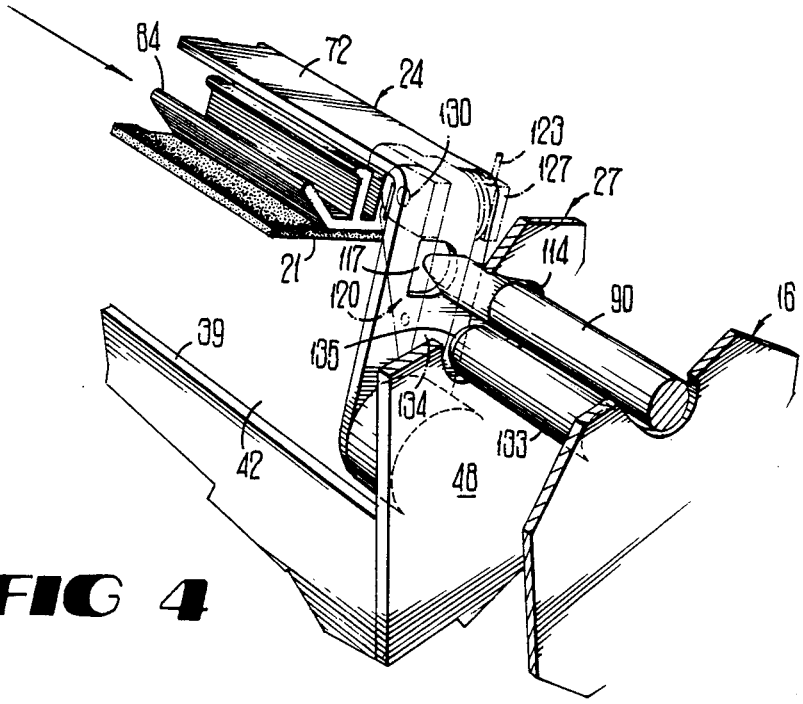
FIG. 4 is a fragmentary pictorial view of the transfer belt cleaning station illustrating the movable shaft and the fixed shaft entering the cleaning blade housing as the cleaning blade station is inserted into the print engine. A latch and bracket are illustrated with broken lines to show the position of the latch and bracket in front of those objects illustrated with solid lines.
Figure 5:
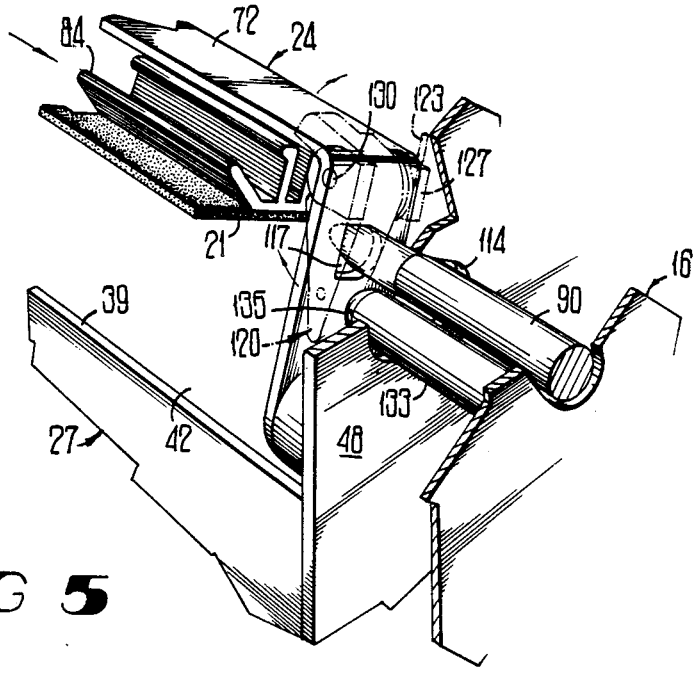
FIG. 5 is a fragmentary pictorial view of the transfer belt cleaning station illustrating the fixed shaft engaging the spring operated latch as the cleaning blade station is inserted into the print engine. A latch and bracket are illustrated with broken lines to show the position of the latch and bracket in front of those objects illustrated with solid lines.
Figure 6:
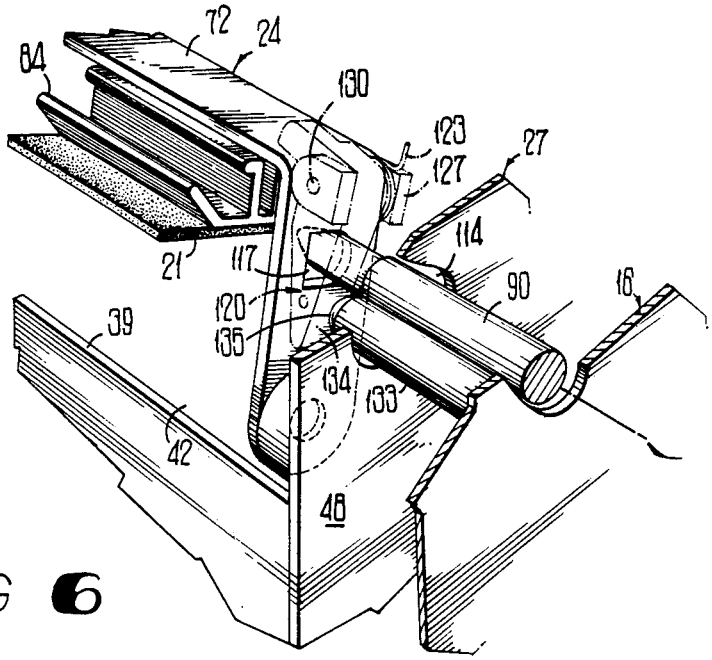
FIG. 6 is a fragmentary pictorial view of the transfer belt cleaning station illustrating the cleaning blade holder in the unlocked position. A latch and bracket are illustrated with broken lines to show the position of the latch and bracket in front of those objects illustrated with solid lines.

As shown in in FIG. 6, the cleaning blade locking mechanism comprises a wedge-shaped latch 120 and a torsion spring 123. A two-sided bracket 127 with a central opening protrudes from the interior of the cleaning blade housing end plate 48. The latch 120, the torsion spring 123 and the two-sided bracket 127 are each illustrated in FIGS. 4, 5 and 6 with broken lines to illustrate the position of the locking mechanism in front of the cleaning blade holder 24. The upper portion of the latch 120 and the torsion spring 123 are mounted in the central opening of the two-sided bracket 127 by a pin 130 about which the latch rotates. One end of the tension spring 123 is attached to the lower portion of the latch 120 and the opposite end of the tension spring rests against the end plate 48. The coil 123 creates a counterclockwise moment about the pin 130 (as viewed in FIG. 4) which forces down the upper portion of the latch 120 extending beyond the two-sided bracket 127 in front of the cleaning blade holder 24, thereby stopping the cleaning blade holder from springing forward.

A shaft 133 (shown in FIGS. 4, 5 and 6) is fixed to the upper frame 16 and extends therefrom substantially parallel and adjacent to the movable shaft 90. The fixed shaft 133 is positioned to extend through the hole 114 in the cleaning blade housing end plate 48 and contact the lower tapered tip 134 of the wedge-shaped latch 120 (see FIG. 5) when the transfer belt cleaning station 13 is secured within the print engine 10.

Before the transfer belt cleaning station 13 is inserted into the print engine 10, the cleaning blade holder 24 is locked down by the latch 120 so that the cleaning blade 21 remains withdrawn from the transfer belt 19 and cannot scrape across the surface of the transfer belt. When the transfer belt cleaning station 13 is inserted into the print engine 10, the cleaning blade housing 27 is pushed towards the fixed shaft 133 and the movable shaft 90 as sequentially shown in FIGS. 4, 5 and 6. In the locked position, the cleaning blade holder 24 is set so that the hole 117 is aligned with the movable shaft 90. Because the length of the movable shaft 90 extends beyond the length of the fixed shaft 133, as the cleaning blade housing 27 approaches the movable shaft 90, the movable shaft 90 enters the hole 117 in the cleaning blade holder 24 before the fixed shaft 133 contacts the latch 120. (See FIG. 4).

After the movable shaft 90 enters the hole 117 in the cleaning holder 24, the end 135 of the fixed shaft 133 contacts the lower end of the latch 120 causing a clockwise moment about the pin 130 as viewed in FIG. 5. The clockwise moment compresses the torsion spring 123 and forces upwardly the upper portion of the latch 120 extending beyond the two-sided bracket 127, thereby releasing the cleaning blade holder 24. Because the movable shaft 90 has already engaged the cleaning blade holder 24 and the solenoid 87 is deactivated, the movable shaft 90 prevents the released cleaning blade holder 24 from springing forward and striking the surface of the transfer belt 19. Also, because the cleaning blade holder 24 now is unlocked, it is free to move the cleaning blade 21 for contacting the transfer belt 19 as shown in FIG. 7 when the solenoid 87 is activated.

To remove the transfer belt cleaning station 13, the solenoid 87 is deactivated so that the spring 96 retracts the cleaning blade holder 24 from the transfer belt as seen in FIG. 3. The cleaning blade housing 27 now is pulled out of the print engine 10 by a handle 136 as shown in FIG. 1. Because the length of the movable shaft 90 extends beyond the length of the fixed shaft 133, as the cleaning blade housing 27 is pulled from the print engine 10 the fixed shaft releases the latch 120 before the movable shaft leaves the hole 117 in the cleaning blade holder 24. As a result, the latch 120 locks the cleaning blade holder 24 in the retracted position before the movable shaft 90 releases the cleaning blade holder, thereby preventing the cleaning blade holder from springing forward and striking the surface of the transfer belt 19. Also, because the cleaning blade holder 24 is locked in the retracted position, the cleaning blade 21 does not scrape across the surface of the transfer belt 19 as the transfer belt cleaning station 13 is pulled out of the print engine 10.

It should be understood that the foregoing relates only to a preferred embodiment of the present invention, and that numerous changes and modifications therein may be made without departing from the spirit and scope of the invention as defined by the following claims.

We claim:

1. An electrophotographic print engine comprising:

a transfer medium for transferring toner;

means for cleaning toner from the transfer medium;

means for selectively positioning the cleaning means at a predetermined location within the electrophotographic print engine, and for alternatively removing the cleaning means from the electrophotographic print engine;

means for selectively moving the cleaning means into contact with the transfer medium, and for alternatively moving the cleaning means away from the transfer medium;

means for locking the cleaning means in a position away from the transfer medium; and means for controlling the locking means so the cleaning means remains in the locked position away from the transfer medium while the positioning and removing means is operating, whereby damage to the transfer medium by the cleaning means is prevented while removing or installing the cleaning means, and so that the cleaning means is unlocked from the locked position while the cleaning means is secured within the electrophotographic print engine whereby the cleaning means can selectively move into contact with the transfer medium.

2. Apparatus as in claim 1, wherein:

the controlling means is operative to lock the cleaning means in response to withdrawing the cleaning means from the predetermined location.

3. The electrophotographic print engine as in claim 1, wherein:

the controlling means comprises a shaft fixed within the electrophotographic print engine so the fixed shaft engages the locking means when the cleaning means is secured within the electrophotographic print engine, thereby unlocking the cleaning means, and disengages the locking means when the cleaning means is removed from the electrophotographic print engine, thereby locking the cleaning means.

4. The electrophotographic print engine as in claim 3, wherein:

the moving means comprises a movable shaft engaging the cleaning means when the cleaning means is secured within the electrophotographic print engine, and disengaging from the cleaning means when the cleaning means is removed from the electrophotographic print engine.

5. The electrophotographic print engine as in claim 4, wherein:

the movable shaft has a first length and the fixed shaft has a second length;

the movable shaft positioned so the first length is substantially parallel to the second length and extends beyond the second length in the direction of removal of the cleaning means, whereby the fixed shaft activates the locking means to the locked position before the movable shaft disengages from the cleaning means when the cleaning means is removed from the electrophotographic print engine; and the movable shaft is positioned to engage the cleaning means before the fixed shaft deactivates the locking means when the cleaning means is secured within the electrophotographic print engine.

6. The electrophotographic print engine as in claim 1, wherein:

the controlling means comprises a member in fixed relation to the electrophotographic print engine so as to engage the locking means when the cleaning means is at a predetermined location within the electrophotographic print engine, thereby unlocking the cleaning means; and the fixed member disengages the locking means when the cleaning means is removed from the predetermined location within the electrophotographic print engine, thereby locking the cleaning means in the position away from the transfer medium.

7. The electrophotographic print engine as in claim 6, wherein:

the moving means comprises a movable member connected to the print engine in position to engage the cleaning means when the cleaning means is secured within the electrophotographic print engine, and operative to disengage from the cleaning means when the cleaning means is removed from the electrophotographic print engine.

8. The electrophotographic print engine as in claim 7, wherein:

The fixed member is positioned to activate the locking means to the locked position before the movable member disengages from the cleaning means as the cleaning means is removed from the electrophotographic print engine; and the movable means is positioned to engage the cleaning means before the fixed means deactivates the locking means as the cleaning means is secured within the electrophotographic print engine.

9. Apparatus as in claim 7 wherein:

the cleaning means travels on a predetermined path for removal from and return to the print engine;

the locking means and the moving means travel with the cleaning means during removal and return;

the fixed member and the movable member are positioned in relation to the predetermined path so that the fixed member actuates the locking means to the locked position before the movable member disengages from the cleaning means as the cleaning means is removed from the print engine; and the movable member is positioned to reengage the cleaning means to keep the cleaning means away from the transfer medium before the fixed member deactivates the locking means as the cleaning means is returned to the print engine.

* * * * *